United States Patent [19]

Cutting

[11] 4,295,664

[45] Oct. 20, 1981

[54] MEDICATION RECORD-KEEPING PACKAGE

[76] Inventor: Gloria T. Cutting, 1426 Camden Ave., Los Angeles, Calif. 90025

[21] Appl. No.: 950,306

[22] Filed: Oct. 11, 1978

Related U.S. Application Data

[63] Continuation of Ser. No. 741,454, Nov. 12, 1976, abandoned.

[51] Int. Cl.[2] ..... B42D 15/00

[52] U.S. Cl. ..... 283/1 A; 282/23 R

[58] Field of Search ..... 283/1 A, 63 A, 66 R, 283/66 A; 282/23 R

[56] References Cited

U.S. PATENT DOCUMENTS

| | | | |
|---|---|---|---|
| 603,861 | 5/1898 | Shaft et al. | 282/23 R |
| 1,151,075 | 8/1915 | Wellman | 283/66 A |
| 1,419,831 | 6/1922 | Eckes | 283/1 A |
| 1,442,266 | 1/1923 | Graham et al. | 283/66 A |
| 1,634,240 | 6/1927 | Wilford | 282/3 R |
| 2,173,332 | 9/1939 | Hoffmann | 282/23 R |
| 2,757,940 | 8/1956 | Moss | 282/23 R |
| 3,620,891 | 11/1971 | Jones et al. | 281/21 R |
| 4,116,470 | 9/1978 | Johnsen | 283/66 A |

*Primary Examiner*—John McQuade

*Attorney, Agent, or Firm*—Fulwider, Patton, Rieber, Lee & Utecht

[57] ABSTRACT

The cover sheet of a medication record-keeping package provides a chart on which a record is made of medication prescribed for administration to a patient. Pressure sensitive transfer sheets of increasing width are stacked beneath the cover sheet to provide duplicate records of the information recorded within various time periods. The transfer sheets are successively removed and attached to a retention sheet to form a periodically updated supplemental record.

16 Claims, 4 Drawing Figures

MEDICATION RECORD-KEEPING PACKAGE

This is a continuation, of application Ser. No. 741,454, filed Nov. 12, 1976 and abandoned upon the filing hereof.

BACKGROUND OF THE INVENTION

The present invention relates to the keeping of medical records, and more particularly to a package of forms for keeping records relating to the medication administered to an individual patient.

The periodic administration of medication to patients in accordance with the instructions of their physicians is an important nursing function of modern hospitals. Accurate and readily available records of the medication prescribed and administered is essential to the performance of this function.

According to the conventional record-keeping techniques, physicians enter the medication prescribed, the dosage, and other such information on standardized charts, one such chart being provided for each patient. All the current charts pertaining to patients in a particular area of the hospital are collected in a loose leaf binder or the like and carried on a medication cart that is wheeled along a route from patient to patient. The physician's instructions are available for the nurse's reference at the patient's bedside, and she can immediately record the administration of the medicine to the patient to update appropriate columns on the chart.

Since the original medication charts are carried about on the medication cart and are not readily available to all nurses or physicians, it is conventional to maintain a periodically updated supplemental medication record at a nursing station or other fixed location. The copying of information from the chart carried on the medication cart to the supplemental record is time consuming and is a potential source of serious errors.

The principal objective of the present invention is to provide for the efficient and substantially error free transfer of information from the original medication record to the supplemental record.

SUMMARY OF THE INVENTION

The present invention relates to a record-keeping package for hospital use in which information recorded on the cover sheet of the package is duplicated on underlying pressure sensitive transfer sheets. Periodically, a transfer sheet is detached from the cover sheet and attached to a retention sheet to provide a progressively updated supplemental record. The cover sheet containing the original record of the information can be carried on the medicine cart, while the supplemental record is maintained at a fixed location.

More specifically, the cover sheet of the package is in the form of a chart having a medication column on which information relating to the medication prescribed by a physician is recorded. Information relating to the administration of the medication to the patient is entered in administration columns parallel to the medication column, with all information relating to the administration of medication within the designated time period being entered in a single administration column.

The transfer sheets are releasably attached to the cover sheet by a binding means and held beneath the cover sheet to underlie the various administration columns. The supplemental record is generated by periodically detaching a transfer sheet from the cover sheet and attaching it to a retention sheet. The retention sheet includes a plurality of parallel adhesive strips by which the transfer sheets can be attached.

Other features and advantages of the present invention will become apparent from the following detailed description, taken in conjunction with the accompanying drawings, which illustrate, by way of example, the principles of the invention.

DESCRIPTION OF THE PREFERRED EMBODIMENT

An exemplary medication record-keeping package 10, constructed in accordance with the present invention and illustrated in the accompanying drawings, includes a plurality of sheets arranged in an overlying stacked relationship and bound together along one edge 12. A bottom sheet 13 protects the package 10 so that it is easily handled.

Figure 1:
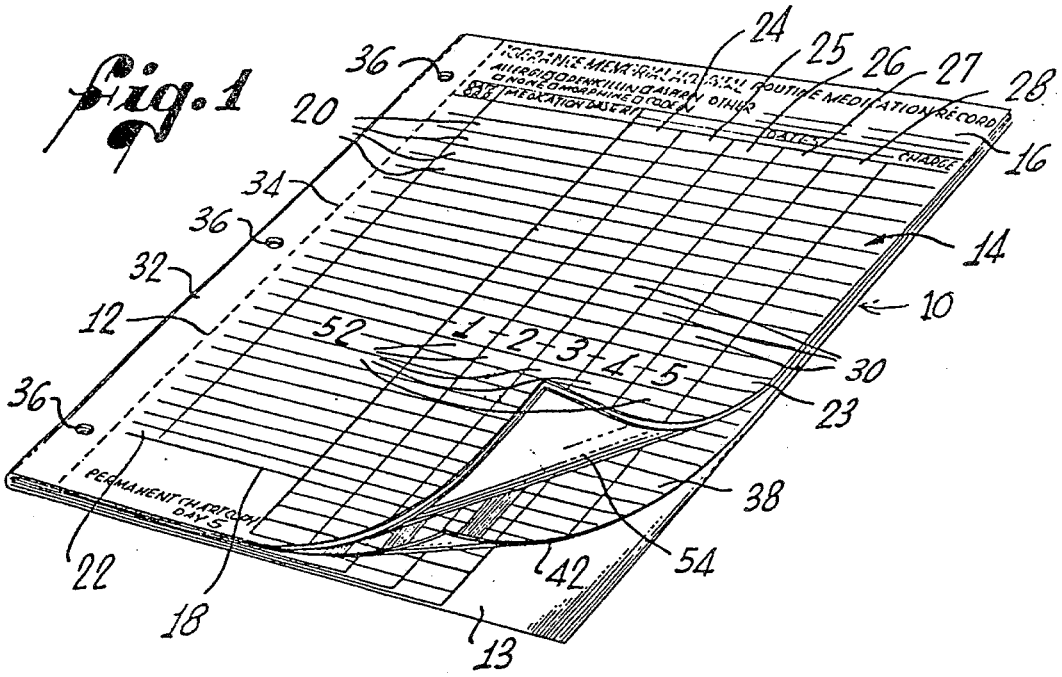
FIG. 1 is a pictorial view of a medication record-keeping package constructed in accordance with the invention, several sheets of the package being turned up at one corner to expose the sheets beneath.

A chart 14 (FIG. 1) that determines the format in which medication information relating to a particular patient is to be recorded is printed on the top sheet 16, known as the cover sheet. The same chart 14, or a portion of the chart appears, on the sheets beneath, each of which has a pressure sensitive coating applied to it to duplicate the information recorded on the cover sheet. The coating may be of a well known type using microencapsulation or ordinary carbon paper (not shown) can be used instead.

The full chart 14, as it appears on the cover sheet 16 (FIG. 1), includes a series of parallel columns. The widest column 18, which is near the left-hand edge 12, is called the medication column and is divided horizontally into a series of rectangular blanks 20. Each item of medication ordered by a physician, along with information pertaining to the dosage, frequency of administration and the like is recorded in one of these blanks 20. The data on which the medication is ordered can be entered in a narrow data column 22 extending along the left-hand edge of the chart 14. Charges to the patient are entered in a column 23 on the right-hand edge.

Immediately to the right of the medication column are administration columns 24 through 28 in which information relating to the administration of medication to the patient is recorded. This administration information, which might include the manner in which the medication was administered, e.g., injection or oral, and the time of day, is entered in the appropriate administration columns 24 through 28. Proceding from left to right away from the medication column 18, each such column corresponds to a successive day, nursing shift or other such period, as determined by the hospital administration.

The administration columns 24 through 28 are of equal width, although narrower than the medication column 18, and are divided horizontally into rectangular blocks 30, so that each block 20 of the medication column 12 has a corresponding block in each of the administration columns. Although six administration columns 24 through 28 are included in this exemplary record-keeping package 10, the optimum number will vary with the administrative practices and average patient stay of a particular facility. The margins of the cover sheet 16 provide space for additional information such as the patient's name, number and allergies, the number of the nursing station responsible for the patient's care and the name of the attending physician.

Each sheet of the package 10, including the cover sheet 16, is joined along its left-hand edge to a tab 32. The sheets are divided from the tabs 32 by perforation lines 34 so they can easily be separated from the package 10. All the tabs 32 are interconnected by glue to serve as a binding for the package 10, and holes 36 are punched in the tabs 32 at evenly-spaced intervals so that the package can be readily inserted in a loose leaf notebook (not shown).

Figure 2:
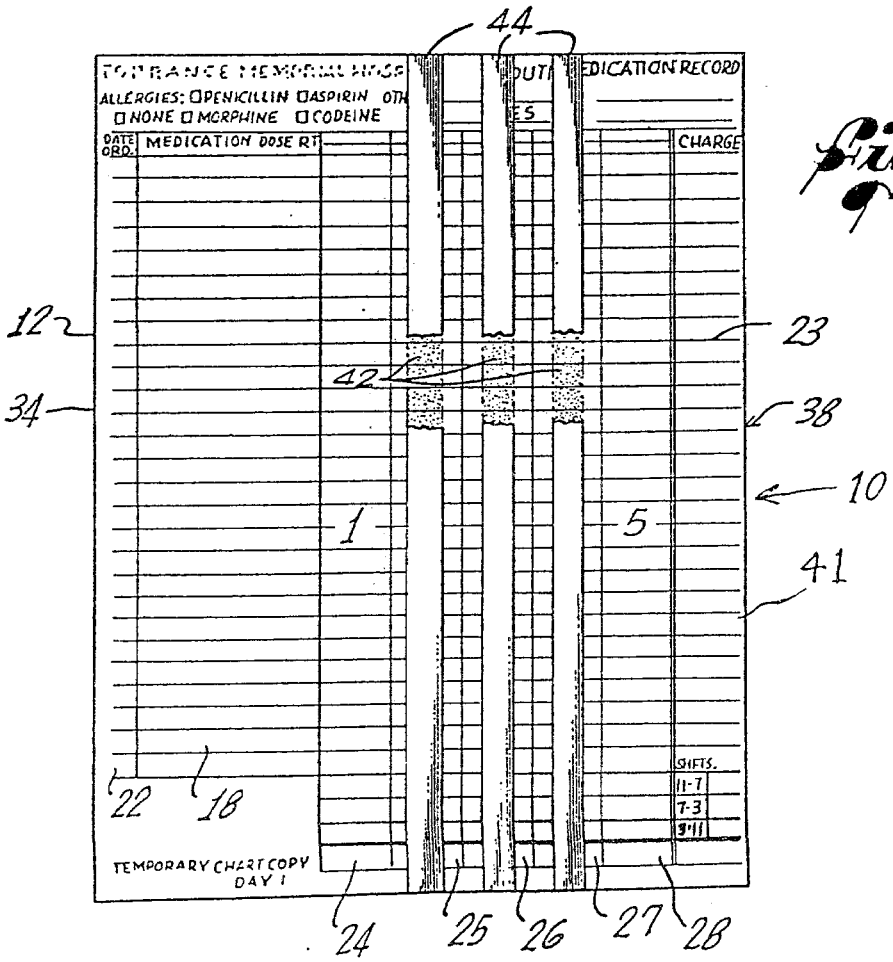
FIG. 2 is a top view of a retention sheet included in the package, protective strips on the retention sheets being partially broken away to expose adhesive strips below.

Beneath the cover sheet 16 is a retention sheet 38 (FIG. 2) on which the full chart 14 appears again. Since a pressure sensitive coating is applied to the retention sheet 38, information recorded on the cover sheet 16 is duplicated on the retention sheet in corresponding locations. A plurality of parallel spaced-apart adhesive strips 42 extend along the centers of each of the administration columns of the retention sheet 38, except for the two end columns, 24 and 28, closest to the medication column 18 on one side and the unbound edge 41 of the retention sheet on the other side. The adhesive strips 40 are covered by elongated protective strips 44 that are easily peeled away to permit attachment of other sheets so that the record maintained on the retention sheet 38 can be periodically updated as explained more fully below.

Figure 3:
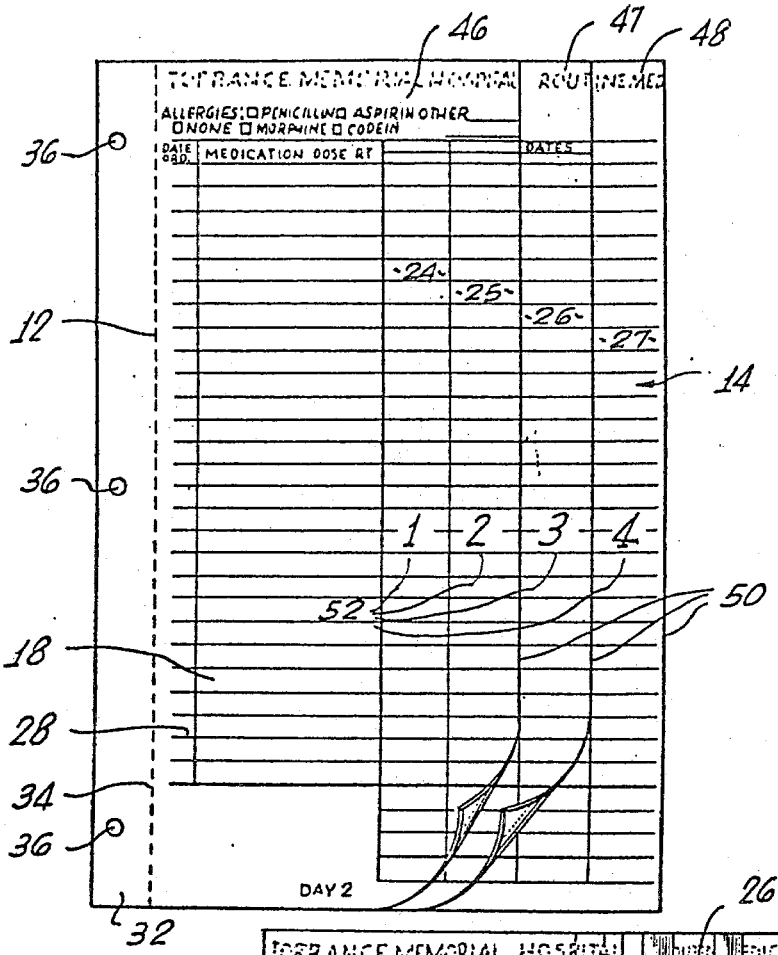
FIG. 3 is a top view of the transfer sheets of the package.
Figure 4:
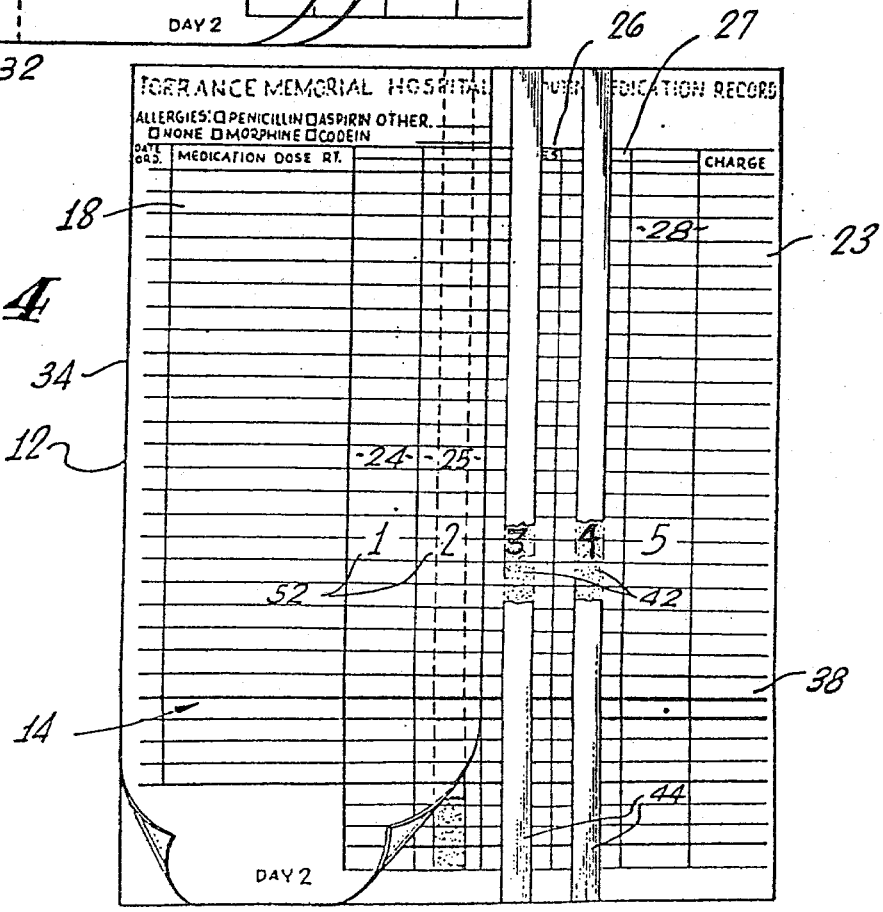
FIG. 4 is a top view of the retention sheet separated from the package with a transfer sheet attached to it.

Underlying the retention sheet 38 is a series of transfer sheets 46, 47 and 48 of progressively increasing width with the smallest sheet on top (FIG. 3). The transfer sheets are aligned with the other sheets of the package 10 along their respective bound left-hand edges 12 so that their unbound right-hand edges 50 are parallel but not contiguous.

Each transfer sheet 46 through 48 is imprinted with that portion of the chart 14 which overlies it. Due to the pressure sensitive coating, the information recorded on the overlying portion of the cover sheet 16 is duplicated on the corresponding portions of the transfer sheets 46 through 48. The narrowest transfer sheet 46 is large enough to include the data column 22, the medication column 18 and the first two administration columns 24 and 25. Each successively larger transfer sheet, 47 and 48, extends beyond the preceding transfer sheet by the width of one administration column. The last and widest transfer sheet 48 includes the entire chart 14 with the exception of the last administration column 28 that extends along the unbound right-hand edge of the chart.

On the first day that the chart 14 is in use, the entire record-keeping package 10 is carried on the medication cart, there being no completed administration columns 24 through 28 to be made available by way of a supplemental record at the nursing station. Once the period covered by the first administration column 24 adjacent the medication column 18 has expired, the retention sheet 38 is removed from the package 10 and kept at the nursing station. Information regarding the administration of medication during the expired period is then available from the retention sheet 38.

After the second administration column has been completed, the first and smallest transfer sheet 46 is removed from the package 10 and attached to the retention sheet 38 so that it overlies the medication column 18 and the first two administration columns 24 and 25. In this way, the supplemental record at the nursing station is updated to include the now completed second administration column 25. To aid in positioning the transfer sheets 46 through 48, indicia 52 appear on the administration columns 24 through 28 corresponding to indicia carried by the administration columns 24 through 28 of the retention sheet 38 beneath the protective strips 44. The transfer sheet 46 is held in place by the adhesive strip 42 after the removal of the overlying protective strip 44. The left-hand edge of the transfer sheet 46 remains unbound so that the retention sheet 34 below can be referred to in the event that any record on the transfer sheet is not clearly legible.

Upon the completion of each of the next two administration columns 25 and 26, the remaining transfer sheets 47 and 48 are removed from the package 10 and attached to the retention sheet 38 in like manner. After the completion of the last administration column 28 on the chart 12, a new record-keeping package 10 is assigned to the patient and inserted in the binder carried on the medication cart. The completed cover sheet 16 is then available for use at other locations as a record of the patient's medication, and the retention sheet 38 with the attached transfer sheets 46 through 48 can be disposed of if desired.

In this embodiment, an additional pressure sensitive sheet 54 is included in the package 10 immediately beneath the cover sheet 16 to provide another complete record of the patient's medication used for pharmaceutical or accounting purposes. This additional sheet may, of course, be omitted, depending upon the requirements of a particular hospital. If desired, an additional transfer sheet (not shown), can underlie only the medication column 18 and the first administration column 26 so that the retention sheet 38 can be removed from the package 10 before the completion of the first administration column 24.

It will be appreciated from the foregoing that the record-keeping package 10 of the present invention conveniently provides a progressively updated supplemental record of a patient's medication. The time consuming process of recopying information onto a second chart is eliminated. In addition, the possibilities of human error are substantially reduced since the supplemental record is made simultaneously with the original record.

While a particular form of the invention has been illustrated and described, it will be apparent that various modifications can be made without parting from the spirit and scope of the invention.

I claim:

1. A medication record-keeping package for hospital use comprising:

a retention sheet having a plurality of parallel, spaced-apart, adhesive strips thereon;

a plurality of elongated, separately removable protective strips overlying and adhering to said adhesive strips;

a cover sheet overlying said retention sheet and said protective strips;

a plurality of transfer sheets each of a different size, said transfer sheets being arranged between said cover sheet and said retention sheet in order of increasing size;

pressure sensitive duplication coating means for reproducing on said retention sheet and said transfer sheets information recorded on said cover sheet;

binding means for releasably attaching said retention sheet, said transfer sheets, and said cover sheet in a predetermined overlying relationship; and a plurality of administration columns delineated on said cover sheet and at least one such column delineated on each of said transfer sheets, each of said columns providing a space for recording the administration of medicine during a particular time period, each successively wider transfer sheet including at least one more of said columns than the preceding transfer sheet, the spacing of said columns corresponding to the spacing of said adhesive strips, whereby said retention sheet can be detached from said binding means, and said transfer sheets can be sequentially detached from said binding means and attached to said retention sheet along said adhesive strips and thereby combined to provide a progressively updated supplemental record of the information recorded on said cover sheet.

2. The medication record-keeping package of claim 1, wherein said cover sheet has a medication column delineated thereon along one side thereof for recording information relating to the prescription of medicine for a patient, said medication column being parallel to said administration columns.

3. The medication record-keeping package of claim 2, wherein the smallest of said transfer sheets includes said medication column and two of said administration columns.

4. The medication record-keeping package of claim 2, wherein said retention sheet has a medication column delineated thereon underlying and corresponding to said medication column of said cover sheet.

5. The medication record-keeping package of claim 1 further comprising a series of indicia appearing on said adhesive strips, and corresponding indicia appearing on at least one administration column of each of said transfer sheets, thereby identifying on said retention sheet the position for each of said transfer sheets.

6. The medication record-keeping package of claim 1, wherein each of said transfer sheets is aligned with one edge of said cover sheet.

7. A medication record-keeping package for hospital use comprising:

a cover sheet in the form of a chart having delineated thereon a medication column for recording information relating to the prescription of medication for a patient, and a plurality of administration columns parallel to said medication column for recording information relating to the administration of medication to that patient during a particular time period;

a series of transfer sheets beneath said cover sheet, each successive transfer sheet being positioned beneath at least one administration column of said cover sheet that does not overlie the preceding transfer sheet of said series;

a retention sheet;

binding means for releasably attaching said transfer sheets and said retention sheet to said cover sheet and attachment means for attaching said transfer sheets to said retention sheet at predetermined locations after detachment of said transfer sheets from said cover sheet to provide a progressively updated supplemental record of the information recorded on said cover sheet, said attachment means comprises a plurality of adhesive strips on said retention sheet spaced apart by a distance equal to the width of one of said administration columns.

8. The medication record-keeping package of claim 7 further comprising additional binding means for releasably attaching said retention sheet to said cover sheet.

9. The medication record-keeping package of claim 7, wherein said retention sheet has a medication column delineated thereon underlying said medication column of said cover sheet.

10. A medication record-keeping package for hospital use comprising:

a cover sheet;

a series of transfer sheets arranged in an overlying stacked relationship;

pressure sensitive duplication means for reproducing on said transfer sheets information recorded on said cover sheet;

a retention sheet;

binding means for releasably attaching each of said transfer sheets and said retention sheet to said cover sheet, said binding means comprising a plurality of interconnected tabs and a plurality of perforation lines, each of said transfer sheets and said retention sheet being attached to one of said tabs and divided therefrom by one of said perforation lines, the widths of at least some of said transfer sheets, measured perpendicularly to said perforation lines, being different from the widths of other said transfer sheets; and attaching means for attaching said transfer sheets to said retention sheet to provide a progressively updated supplemental record of information recorded on said cover sheet.

11. The medication record-keeping package of claim 10 wherein a plurality of parallel administration columns are delineated on said cover sheet and at least one such column is delineated on each of said transfer sheets, each said column providing a space for recording the administration of medication during a particular time period, said transfer sheets being of different widths and each successively wider transfer sheet including at least one more of said columns than the preceding transfer sheet.

12. The medication record-keeping package of claim 11, wherein the difference between the widths of any two of said transfer sheets is equal to the width of an integral number of said columns.

13. The medication record-keeping package of claim 11, wherein said attaching means comprises a plurality of parallel adhesive strips formed on said retention sheet, said strips being spaced-apart by a distance equal to the width of one of said columns.

14. The medication record-keeping package of claim 11, wherein said transfer sheets are arranged in order of progressively increasing width, the narrowest of said transfer sheets being closest to said cover sheet.

15. The medication record-keeping package of claim 10, wherein said attaching means comprises a plurality of adhesive strips each corresponding to one of said transfer sheets, and a plurality of removable protective strips overlying and adhering to said adhesive strips.

16. The medication record-keeping package of claim 10, wherein said binding means further comprises an additional interconnected tab joined to said retention sheet, and an additional perforation line dividing said retention sheet from said additional tab.

* * * * *